United States Patent [19]

Fujimori et al.

[11] Patent Number: 4,474,849

[45] Date of Patent: Oct. 2, 1984

[54] COATED HARD ALLOYS

[75] Inventors: Naoji Fujimori; Akira Doi; Yasuhiro Shimizu, all of Itami, Japan

[73] Assignee: Sumitomo Electric Industries, Ltd., Osaka, Japan

[21] Appl. No.: 419,498

[22] Filed: Sep. 17, 1982

[30] Foreign Application Priority Data

Oct. 1, 1981 [JP] Japan ..... 56-157129

[51] Int. Cl.[3] ..... B32B 15/04

[52] U.S. Cl. ..... 428/332; 428/698; 428/699; 428/701

[58] Field of Search ..... 428/698, 701, 702, 332, 428/699

[56] References Cited

U.S. PATENT DOCUMENTS 4,357,382 11/1982 Lambert et al. ..... 428/698 X
4,389,465 6/1983 Nakai et al. ..... 428/698
4,399,168 8/1983 Kullander et al. ..... 428/698 X

*Primary Examiner*—Thomas J. Herbert, Jr.
*Attorney, Agent, or Firm*—Wenderoth, Lind & Ponack

[57] ABSTRACT

Coated hard alloys excellent in toughness and wear resistance comprise a substrate of hard alloy and at least one coating layer thereon, at least one of the coating layers being of amorphous alumina.

9 Claims, No Drawings

COATED HARD ALLOYS

BACKGROUND OF THE INVENTION

1. Field of the Invention

This invention relates to coated hard alloys or cemented carbides and more particularly, it is concerned with an alumina-coated tool having a particularly excellent cutting property.

2. Description of the Prior Art

At the present time, many coated hard alloys have been used as cutting tools excellent in wear resistance as well as in toughness in the field of mechanical working or machining, the coated hard alloys being produced by coating hard alloys consisting of at least one of carbides, nitrides, carbonitrides and carboxynitrides bonded by an iron group metal with hard layers of carbides or nitrides.

Furthermore, it is well known that alumina-coated tools using $Al_2O_3$ as a part of the coating in the above described hard alloys have a higher cutting property due to the wear resistance of $Al_2O_3$ as a ceramic as compared with the above described coated tools.

As to this $Al_2O_3$ layer, $\alpha$-type crystal or $\kappa$-type crystal $Al_2O_3$ has hitherto been proposed and any of the $Al_2O_3$ crystal coating can be formed by the chemical vapor deposition method (CVD method). As well known in the art, $\alpha$-type $Al_2O_3$ is a high temperature stable phase of above 1000° C. and $\kappa$-type $Al_2O_3$ is formed below this temperature. In view of the relationship with reaction rate, the stable zone of $\kappa$-$Al_2O_3$ is considered to be in the range of 800° to 1000° C.

Since the strength of ceramics is generally determined in inverse proportion to the grain size of crystal grains thereof, it is thought important to contain smaller crystal grains. In order to reduce the crystal grains, not only formation at a low temperature but also the surface smoothness of a substrate employed are important.

SUMMARY OF THE INVENTION

It is an object of the present invention to provide an alumina-coated hard alloy suitable for use as a cutting tool.

It is another object of the present invention to provide an alumina-coated tool having an excellent cutting property.

It is a further object of the present invention to provide a coated hard alloy with more excellent toughness and wear resistance using amorphous alumina as the coating material, than alumina-coated hard alloys of the prior art.

These objects can be attained by a coated hard alloy comprising a substrate of hard alloy and one or more coating layers thereon, at least one of the coating layers being of amorphous alumina.

DETAILED DESCRIPTION OF THE INVENTION

The inventors have made various studies on the mechanism of forming $Al_2O_3$ crystal film and the properties thereof and have reached the present invention. That is to say, the present invention provides a coated hard alloy more excellent in toughness and wear resistance than that having the prior art alumina coating by the use of amorphous alumina. Now it is found that amorphous alumina having no grain boundary is capable of exhibiting a higher strength and toughness independently of the state of a substrate and when an amorphous alumina-coated hard alloy is used as a tool, it exhibits an excellent wear resistance since there is no phenomenon of separation by the unit of crystal grain.

In the case of use in a cutting tool, the coating thickness of this amorphous alumina is preferably in the range of 0.5 to 10 $\mu$m since if the thickness is less than 0.5 $\mu$m, the wear resistance as alumina is not sufficient and if more than 10 $\mu$m, the toughness is not satisfactory as the tool. Amorphous alumina gives a considerable effect when it is directly coated onto a hard alloy, but the cutting performance can further be improved when a hard alloy is firstly coated with a hard compound such as TiC, TiN, TiCN, TiCNO, etc. in known manner and then coated with amorphous alumina. In the latter case, however, the total thickness of the coating layers should preferably be at most 20 $\mu$m from the toughness of a tool.

Formation of amorphous alumina is generally carried out by the physical vapor deposition method (PVD) such as ion sputtering or ion plating, ordinary chemical vapor deposition method (CVD) or plasma CVD method, with similar effects.

The hard alloy used as the substrate in the present invention consists generally of at least one of carbides, nitrides, carbonitrides and carboxynitrides of Group 4a, 5a and 6a elements of Periodic Table, bonded by at least one of iron group metals (Co, Ni, Fe). In particular, cemented carbides such as WC-Co alloys are more preferable.

The intermediate layer optionally used in the present invention is generally of at least one of hard compounds, i.e. carbides, nitrides, carbonitrides, borides, oxides of Group 4a, 5a and 6a elements of Periodic Table, and solid solutions thereof. $Si_3N_4$, SiC, AlN, $SiO_2$, $B_4C$, etc. can be used.

The following examples are given to illustrate the present invention in greater detail without limiting the same.

EXAMPLE 1

A hard alloy of ISO M10 (WC-TiC-Co, Form SNG 432) was coated with $\alpha$-$Al_2O_3$ in a thickness of 2 $\mu$m be CVD method in known manner to obtain a comparative sample and coated on the other hand with amorphous $Al_2O_3$ in a thickness of 2 $\mu$m by ion plating to obtain another sample of the present invention, and the resulting two samples were subjected to a cutting test under the following conditions:

| | |
|---|---|
| Workpiece | FCD-40 |
| Cutting Speed | 200 m/min |
| Depth of Cut | 2 mm |
| Feed | 0.25 mm/rev |

As a result of this test, the comparative sample showed a $V_B$ wear of 0.3 mm by cutting for 8 minutes, which was judged to be exhausted, while the sample of the present invention showed a $V_B$ of 0.25 mm even after cutting for 30 minutes.

EXAMPLE 2

A hard alloy of ISO P 30 (WC-TiC-TaC-Co, Form SNG 432) was coated with TiC by CVD method in known manner and coated further with amorphous $Al_2O_3$ by plasma CVD method with varying the coating thickness of the each layer as shown in Table 1. The resulting samples were subjected to the following two kinds of cutting tests thus obtaining results shown in Table 1.

| | Test 2 | Test 3 |
|---|---|---|
| Workpiece | S45C Steel | SCM-3 Cylindrical Steel with Grooves |
| Cutting Speed | 250 m/min | 150 m/min |
| Depth of Cut | 2 mm | 1.5 mm |
| Feed | 0.35 mm/rev | 0.15–0.25 mm/rev |
| Judgment | Judged to be exhausted at $V_B = 0.3$ mm (min) | Fracture ratio (%) in cutting edge for 10 minutes |

TABLE 1

| Sample No. | $Al_2O_3$ Thickness (μm) | TiC Thickness (μm) | Total Thickness (μm) | Test 2 (min) | Test 3 (%) |
|---|---|---|---|---|---|
| 1 | 0.1 | 2 | 2.1 | 5 | 5 |
| 2 | 0.5 | 2 | 2.5 | 24 | 15 |
| 3 | 1 | 2 | 3 | 43 | 22 |
| 4 | 5 | 2 | 7 | 52 | 24 |
| 5 | 10 | 2 | 12 | 55 | 33 |
| 6 | 20 | 2 | 22 | 56 | 75 |
| 7 | 30 | 2 | 32 | 20 | 98 |
| 8 | 1 | 5 | 6 | 51 | 30 |
| 9 | 1 | 10 | 11 | 58 | 38 |
| 10 | 1 | 15 | 16 | 70 | 40 |
| 11 | 1 | 20 | 21 | 74 | 44 |
| 12 | 1 | 23 | 24 | 80 | 75 |
| 13 | 1 | 30 | 31 | 20 | 99 |

As can be seen from this table, the wear resistance is increased and the life is lengthened when the thickness of amorphous $Al_2O_3$ is 0.5 μm or more, but when the total thickness of the coating layers exceeds 20 μm, the breakage ratio is rapidly increased and the toughness of the tool is deteriorated although the cutting life is long.

The foregoing Examples show the cases of coating one layer of amorphous $Al_2O_3$ and coating amorphous $Al_2O_3$ on TiC layer, but the merits or effects of the present invention as shown in Example 2 were not changed even in the case of coating a hard alloy with TiC layer, amorphous $Al_2O_3$ layer and TiN layer in order.

What is claimed is:

1. A coated hard alloy comprising as a substrate a hard alloy and at least one coating layer thereon, said at least one coating layer being amorphous alumina.

2. The coated hard alloy as claimed in claim 1, wherein the hard alloy consists of at least one member selected from the group consisting of carbides, nitrides, carbonitrides and carboxynitrides of Group 4*a*, 5*a* and 6*a* elements of Periodic Table and solid solutions thereof, bonded by at least one member selected from iron group metals.

3. The coated hard alloy as claimed in claim 1, wherein the outermost layer consists of amorphous alumina.

4. The coated hard alloy as claimed in claim 1, wherein the thickness of the coating layer of amorphous alumina is 0.5 to 10 μm.

5. The coated hard alloy as claimed in claim 1, wherein the total thickness of the coating layers is 0.5 to 20 μm.

6. The coated hard alloy as claimed in claim 1, wherein the amorphous alumina is coated by at least one method of ion sputtering, ion plating, CVD and plasma CVD methods.

7. The coated hard alloy as claimed in claim 1, wherein the amorphous alumina is coated onto the substrate through an intermediate layer.

8. The coated hard alloy as claimed in claim 7, wherein the intermediate layer consists of at least one hard compound selected from the group consisting of carbides, carbonitrides, nitrides, borides and oxides of Group 4*a*, 5*a* and 6*a* elements of Periodic Table and solid solutions thereof.

9. The coated hard alloy as claimed in claim 7, wherein the intermediate layer consists of at least one hard compound selected from the group consisting of $Si_3N_4$, SiC, AlN, $SiO_2$ and $B_4C$.

* * * * *